United States Patent [19]

Winand

[11] Patent Number: 4,830,665

[45] Date of Patent: May 16, 1989

[54] PROCESS AND UNIT FOR PREPARING ALLOYED AND NON-ALLOYED REACTIVE METALS BY REDUCTION

[75] Inventor: René Winand, Rixensart, Belgium

[73] Assignee: Cockerill S.A., Seraing, Belgium

[21] Appl. No.: 496,876

[22] Filed: May 22, 1983

Related U.S. Application Data

[63] Continuation-in-part of Ser. No. 165,944, Jul. 3, 1980, abandoned.

[30] Foreign Application Priority Data

Jul. 5, 1979 [LU] Luxembourg ..... 81469

[51] Int. Cl.[4] ..... C22B 34/00; C22B 26/00; C22B 21/00; C22B 23/00

[52] U.S. Cl. ..... 75/10.19; 75/62; 75/67 R; 75/68 R; 75/82; 75/84.4; 266/905

[58] Field of Search ..... 75/66, 84.4, 84.5, 10 R, 75/62, 68 R, 67 A, 67 R, 82, 10.19, 10.21; 261/79 A; 266/905

[56] References Cited

U.S. PATENT DOCUMENTS

| | | | |
|---|---|---|---|
| 2,485,038 | 10/1949 | Culkosky | 261/79 A |
| 2,760,858 | 8/1956 | Findlay | 75/84.4 |
| 2,782,118 | 2/1957 | Hood | 75/84.5 |
| 2,826,491 | 3/1958 | Findlay | 75/84.4 |
| 2,828,201 | 3/1958 | Findlay | 75/84.4 |
| 2,997,385 | 8/1961 | Winter | 75/84.5 |
| 3,495,384 | 2/1970 | Alliger | 261/115 |
| 3,535,109 | 10/1970 | Ingersoll | 75/84.4 |
| 3,825,415 | 7/1974 | Johnston | 75/84.5 |
| 3,862,907 | 1/1975 | Shimotsuma | 261/79 A |
| 4,080,194 | 3/1978 | Fey | 75/84.5 |
| 4,146,389 | 3/1979 | Karlovitz | 75/10 R |
| 4,287,933 | 9/1981 | Elsner | 164/452 |

FOREIGN PATENT DOCUMENTS

| | | |
|---|---|---|
| 770017 | 10/1967 | Canada . |
| 736852 | 9/1955 | United Kingdom . |
| 741630 | 12/1955 | United Kingdom . |
| 1054162 | 1/1967 | United Kingdom . |
| 2057016 | 3/1981 | United Kingdom . |

OTHER PUBLICATIONS

V. A. Garmata et al., *Metallurgia Titana, M.*, "Vosstanovlenye V Apparatakh, Shabzhennykh Forsunkami" 1968, pp. 359–365.

*Primary Examiner*—John J. Zimmerman
*Attorney, Agent, or Firm*—Browdy and Neimark

[57] ABSTRACT

A process for preparing alloyed or non-alloyed, reactive metals by reaction of halides thereof, in particular chlorides, with a reducing agent at a temperature higher than the melting temperature of the metal to be developed, comprises solidifying the developed metal while maintaining in the reaction zone wherein the reduction proceeds, a layer of this metal in the liquid state, at a temperature higher than the boiling or sublimation temperature of the other reaction products at the pressure at which the reduction develops, these other reaction products being substantially continuously discharged in the gaseous state.

21 Claims, 2 Drawing Sheets

Fig. 1
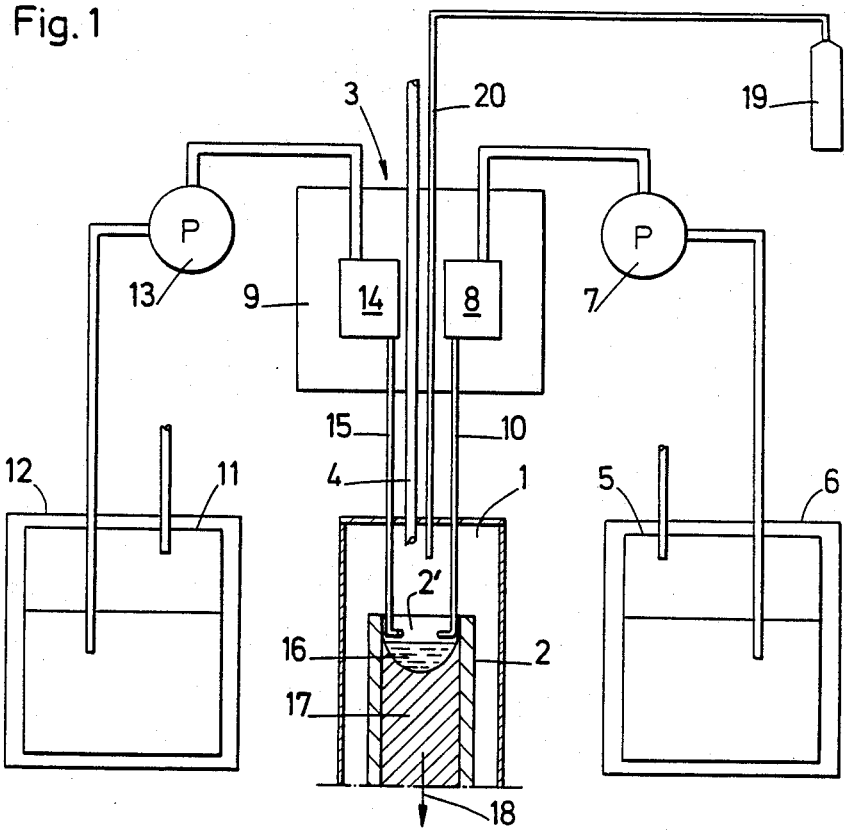
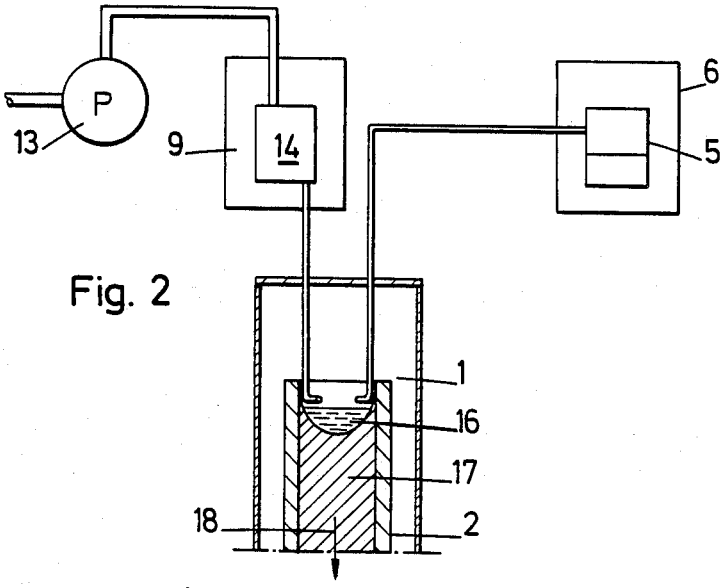
Fig. 2

PROCESS AND UNIT FOR PREPARING ALLOYED AND NON-ALLOYED REACTIVE METALS BY REDUCTION

This application is a continuation-in-part of application Ser. No. 165,944, filed July 3, 1980, now abandoned.

The present invention relates to a process for the preferably continuous production of alloyed or non-alloyed reactive metals by reaction of their halides, in particular chlorides, with a reducing agent at a higher temperature than the melting temperature of the metal to be developed.

The term "reactive metals" means, in the case present invention, titanium, zirconium, hafnium, tantalum, niobium, molybdenum, tungsten, vanadium, aluminum, silicon, cobalt, nickel, magnesium, thorium, uranium, beryllium and chromium.

The known processes for preparing said metals generally present the drawback either of being discontinuous or of necessitating a metal remelting step, or of being expensive in regard to energy, or of having very low metallurgical yields.

One of the essential objects of the present invention is to provide a process allowing to remedy these drawbacks.

This is more particularly a process allowing to obtain the following results:

- metals form directly and continuously in the liquid state, the heat necessary for the melting of some metals, or at least the main portion of this heat, being supplied from exothermic reactions, which thus allows to save a high amount of energy;
- the metal is collected as a dense form, preferably in a cooled copper ingot mold.

To this end, the process according to the present invention consists in solidifying the developed metal while maintaining in the reaction zone wherein the reduction proceeds, a layer of this metal in the liquid state, the temperature being moreover higher than the boiling or sublimation temperature of the other reaction products at the pressure at which the reduction develops, these other reaction products being substantially continuously discharged in the gaseous state.

Advantageously, this process consists in maintaining a layer of the metal to be developed in the liquid state above the solidified metal, the latter being as an ingot which is substantially continuously discharged as fast as said metal is developed.

According to a particular embodiment of the present invention, the reagents are charged into said reaction zone in the gaseous state, the reaction zone being in a small area centralized at the top of the ingot. By maintaining the reaction within a small centralized area at the top of the ingot, the calories produced by the exothermic reaction are concentrated in this small area so as to maintain the necessary temperatures of the reactants and to maintain the layer of the metal at the top of the ingot in the liquid state without the necessity of any substantial outside source of heat.

According to a preferred embodiment, the reagents are charged into this reaction zone as a swirling stream so as to allow a coalescence of the liquid metal droplets formed by reaction in this stream and to subject them to a centrifugal force permitting them to be collected directly on the liquid metal layer on the top of the ingot. Preferably, each reactant is charged into the reaction zone at a separate point in the swirling stream so as to cause the mixing of the reactants and thus to cause the reaction to take place within the turbulence of the swirling stream in the small area centralized at the top of the ingot.

The present invention also concerns a unit for carrying out said process.

This unit is characterized in that it comprises means for charging reagents taking part in the reaction in the gaseous state, into the upper portion of a cooled ingot mold, and means for continuously discharging gases issuing from the reduction.

Finally, the invention also relates to the metal such as which is developed by carrying out the process, and/or by means of the unit such as hereinabove described.

Other details and features of the present invention will become apparent from the description which is given hereinafter by way of non-limitative example with reference to the annexed drawings, of some particular embodiments of the process and the unit according to the present invention.

FIG. 1 is a schematic view of a first embodiment of the process and the unit according to the invention.

FIG. 2 is a schematic representation of a second embodiment of this process and this unit.

In the various figures, same reference numerals designate similar or identical elements.

Figure 3:
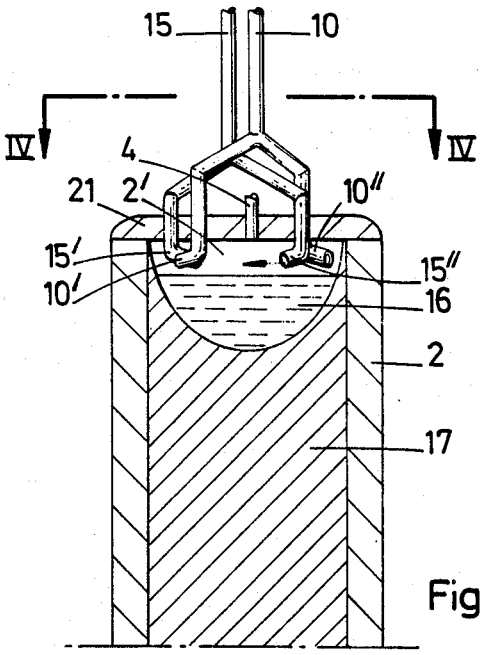
FIG. 3 is a schematic front and cross-sectional view of a third embodiment of the process and the unit according to the invention.

According to the process of the present invention, reduction of a halide of a metal to be developed, in particular of a chloride of the latter, is made at a higher temperature than the melting point of the metal being developed.

More particularly, the reaction temperature is also maintained higher than the boiling or sublimation temperature of all the substances other than the metal and which are present in the reaction zone, at the pressure at which the reduction is made. Consequently, these substances spontaneously leave the reaction zone in the gaseous state.

In particular, the process according to the present invention allows to decrease the cost price of titanium considerably, which makes it accessible to numerous applications in the whole industry. This process also applies to the continuous production of zirconium, hafnium, tantalum, niobium, mobydenum, tungsten, aluminum, silicon, cobalt, nickel, magnesium, thorium, uranium, beryllium and chromium.

Moreover, as mentioned previously, the present invention relates to a unit for the continuous preparation of said reactive metals by reduction of the halides thereof, more particularly for carrying out the above-mentioned process.

This unit consists of a functional apparatus which can be commercially used with a very high productivity.

The annexed figures allow to more concretely illustrate a few particular embodiments of the process and the unit according to the present invention for producing reactive metals by reduction of their halides.

The embodiment such as schematically shown by FIG. 1 comprises a closed chamber 1 above an ingot mold 2 which is cooled for example by means of a water flow (not shown), a device 3 for charging the reagents taking part in the said reduction into the upper portion 2' of the ingot mold 2, and a device 4 for continuously discharging the gases issuing from the reduction.

The device 3 for charging reagents into the upper portion 2' of the ingot mold comprises, for the halid of the metal to be developed, a first enclosure 5 located in a furnace 6 and connected by means of a volumetric pump 7 to a second enclosure 8 provided in another furnace 9.

This second enclosure communicates by means of an injection pipe 10 with this upper portion 2'.

An enclosure 11, also provided in a furnace 12 and intended to contain a reducing metal is connected by means of a volumetric pump 13 with another enclosure 14 of the furnace 9. This enclosure 14 is in turn connected to the closed chamber 1 by an injection pipe 15.

The embodiment of the unit shown in FIG. 1 is more particularly suitable to the reduction of metal halides being in the liquid state at a pressure near to the atmospheric pressure in a sufficiently broad temperature range.

In this case, the halide is maintained in the liquid state in the enclosure 5 with an optional heating by means of the furnace 6 and is pumped by means of the pump 7 into the enclosure 8 of the furnace 9 wherein it is brought to boiling.

This gaseous metal halide is then charged into the upper portion 2' through the injection pipe 10.

The reducing mtal which is in the enclosure 11 is maintained at a temperature which is about 50° C. higher than its melting temperature owing to the furnace 12.

This molten reducing metal is poured by the pump 13 into the enclosure 14 wherein it is also brought to boiling.

The reducing metal in the gaseous state is then charged in a controlled manner into the reaction zone of the closed chamber 1 by means of the injection pipe 15.

The flow rate of the gaseous reducing metal is controlled by the flow rate of the liquid metal by means of the volumetric pump 7 or of a power regulation at the vaporization stage, not shown by FIG. 1.

In the reaction zone located in the portion 2' of the ingot mold 2, or immediately thereabove, the temperature is higher than the melting temperature of the metal to be developed and also higher than the boiling or sublimation temperature of all the other substances taking part in this reaction.

The metal being developed is collected in the ingot mold 2 which consists of a copper cylinder with cooled double wall.

The upper metal layer 16 in contact with the reaction zone remains in the liquid state, while metal 17 around and below said layer is solidified due to said cooling and forms an ingot which is continuously removed downwardly, as indicated by the arrow 18, by means of devices known per se, such as driver rollers, not shown by the Figure.

All the substances other than the metal leave the reaction zone through the device 4 consisting of a disposal stack. These gases can also be optionally directed into a condenser, not shown, in order to recover unconsumed reagents.

Due to the fact that the enclosed chamber 1 is sealed, an atmosphere of inert gas, such as argon or helium, can be in case of need created in this chamber by means of a device 19 containing such a gas and connected to this chamber 1 through a tube 20.

FIG. 2 illustrates a second embodiment of the unit according to the invention for preparing reactive metals by reduction of their halides.

This embodiment differs from that shown by FIG. 1 in the fact that only an enclosure 5 is provided in the device 3 for charging the halide into the upper portion 2' of the ingot mold.

This embodiment is particularly suitable when the halide is not liquid, as with zirconium and hafnium.

Such halides are brought to the gaseous state by sublimation when they are heated by furnace 6.

The gaseous flow rate of these halides to the reaction zone is prescribed by the power dissipated by this furnace.

Advantageously, in particular for not very refractory metals, such as titanium, aluminum, silicon, zirconium, thorium, vanadium, chromium, cobalt, magnesium, uranium and even nickel, the reduction reaction is led under such conditions that the calories necessary to maintain the reaction zone at the above-mentioned temperature, namely higher than the melting temperature of the metal to be produced and higher than the boiling or sublimation temperature of all other substances taking part in the reaction, are only furnished by the exothermic reaction between the halide of the metal to be developed and the reducing metal, such as an alkali or alkaline-earth metal in the small concentrated reaction area at the top of the ingot.

For fairly refractory metals, the metal to be developed can be prepared by simultaneous reduction of the halide with a reducing metal and hydrogen. These are in particular metals, such as titanium, zirconium, thorium, uranium, hafnium, chromium, cobalt, vanadium and possibly nickel in some cases.

Finally, for very refractory metals, such as vanadium, niobium, molybdenum, tungsten and hafnium, the metal is advantageously produced by reduction of the corresponding halide with hydrogen.

When an additional heating in respect to that possibly produced by the reduction reaction appears to be necessary, use may advantageously be made of an electric arc, an arc plasma or inductive plasma torch, a parabolic mirror furnace or a laser beam. For example, when very small installations are comprehended, it may be necessary to add some calories to the reaction zone to compensate for the high thermal losses through the walls of the unit surrounding the reaction zone in such small scale installations. It is intended, however, that any outside source of heat would not be substantial in relation to the heat being generated by the exothermic reaction within the concentrated reaction zone.

Figure 4:
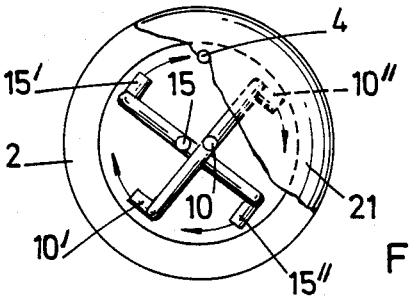
FIG. 4 is a cross-sectional view taken along lines IV—IV of FIG. 3.

FIGS. 3 and 4 relate to a third embodiment of an essential part of the process and the unit according to the invention, presenting the advantage of allowing to obtain a very high production yield of the metal to be prepared.

This process is characterized in that the reagents are charged in the gaseous state into the reaction zone which is located in the upper portion 2' of the ingot mold 2, as a swirling stream. Thus, fine metal droplets formed in this stream unite by impingement so as to form more voluminous droplets. The latter are then projected due to the centrifugal force produced by this swirling movement out of the stream so as to agglomerate on the side walls of the ingot mold and run down thereon due to gravity so as to join the layer 16 overfloating the ingot 17.

This presents the important advantage of a very quick, continuous and also very extensive separation of the metal being prepared out of the reagents and gaseous reaction products.

A very simple means for creating this swirling movement of the gaseous stream in the reaction zone consists in charging the gaseous reagents into the latter according directions in slope with respect to the vertal so as to form for example a circulr or helical stream.

In the embodiment illustrated by FIGS. 3 and 4, each of both reagents is charged into the upper portion 2' of the ingot mold simultaneously in several locations so as to create, on the one hand, a high flow rate of reagents and, on the other hand, in a minimum period a mixture and a contact which are as intimate as possible between the various reagents.

Moreover, in order to create this circular or helical stream, each of pipes 10 and 15 ends in the reaction zone as arms (for example two) provided with injection openings 10', 10'', 15', 15'' which are orientated in directions located in planes which are tangent to cylinders coaxial to the ingot mold 2 and having horizontal components oriented in the same circular direction.

These injection openings are located in or slightly below a cover 21 which sealingly closes the upper portion 2' of the ingot mold and which is provided with the device 4 intended to allow reaction products other than the metal, to be discharged.

Hereinafter a few practical examples of preparation of reactive metals according to the invention process are given.

EXAMPLE 1

Titanium was prepared by reaction of titanium chloride with sodium in the unit according to FIG. 1.

The reducing metal, thus being sodium, was maintained in the enclosure 11 at a temperature of about 150° C., namely about 50° C. higher than the melting point, by means of the furnace 12 which is preferably a resistor electric furnace.

The temperature of the whole upper portion 2' was maintained at a higher value than the boiling temperature of the reagents, in particular at about 1100° C.

The relative amounts of sodium and titanium chloride charged into this upper portion 2' of the ingot mold were regulated by acting on the flow rate of volumetric pumps 7 and 13.

Due to the fact that the titanium chloride is liquid at room temperature, it did not necessitate any heating in the enclosure 5 so that the furnace 6 could be put out of service.

Before injecting the reagents, chamber 1 was first degassed several times by vacuuming and by providing an argon scavenging through the tube 20 at atmospheric pressure or at a slightly higher pressure.

The total flow rate of reagents was controlled so as to ensure in the reaction zone of the upper portion 2' of the ingot mold, a higher temperature than the meltng temperature of the metal (1688° C.), i.e. about 1750° C.

The hourly flow rate of titanium chloride was 2.6 cubic meters (4.4 metric tons) and that of sodium was 2.7 tons. This reagent ratio thus ensured a 25% excess of sodium, which improved the reaction.

The reaction heat was insufficient to maintain the temperature of 1750° C. in the reaction zone.

The cooling of the ingot mold 2, which thus consists of a cylinder of copper or one of alloys thereof, with double walls inside of which a refrigerating fluid circulates, was controlled so as to maintain a layer of metal produced in the liquid state at the upper portion of the ingot mold. The temperature of this liquid metal was maintained at 15°–30° C. higher than its melting point.

It was thus possible to prepare a ton of titanium per hour as a homogenous and voluminous ingot which can be directly subjected to forging and rolling.

The metallurgical yield was near to 90° C.

During this reduction, fumes left the reaction zone progressively. They contained gaseous sodium chloride, titanium side-products and excess sodium. These gases were led to a condenser wherein the total reduction of the metal was completed at low temperature, thus forming dendrites which were reinjected into the liquid layer of metal formed above the ingot.

The ingot molds used had diameters between 80 and 160 mm and heights between 200 and 400 mm.

When the ingots have a diameter of 150 mm, they are removed at a rate of 210 mm/minute, while those having a diameter of 100 mm are removed at a rate of 470 mm/minute, for the flow rates hereinabove mentioned.

EXAMPLE 2

Titanium was produced by simultaneous reduction of titanium chloride with sodium and hydrogen.

The units schematized by FIG. 1 and FIGS. 3 and 4 were used, being however completed with a hydrogen plasma torch, not shown.

4.4 kg of gaseous titanium chloride, 2.7 kg of gaseous sodium and 1.2 cubic meters of hydrogen per hour were charged into the reaction zone wherein a temperature between 2450K and 3570K, preferably 3000K, was maintained.

Excess of hydrogen was recycled.

The temperature conditions for reagents and reaction zone, as well as the injection method were identical to those of Example 1.

The amount of titanium prepared per hour was about 1 kg.

At this reduced scale, an additional heating appeared as necessary due to high thermal losses.

Although this additional heating could be made either by an electric arc, or by a mirror furnace, or by a laser beam or still by any other suitable device, an efficient solution was to use a hydrogen plasma torch.

As a matter of fact, the plasma forming gas is a reduction agent for the titanium chloride and it was thus possible to simultaneously reduce titanium chloride with sodium and hydrogen.

The reduction with sodium is exothermic, while the reduction with hydrogen is endothermic; consequently, the fact of carrying out both reactions simultaneously has as an effect that, when the temperature of reaction varies, one of the two reactions will always be favored and the total metallurgical yield will thus be higher than the yield of each of the two reactions separately considered.

EXAMPLE 3

Zirconium was produced by reduction of zirconium tetrachloride with sodium.

Due to the fact that zirconium tetrachloride is not liquid, a unit of the type shown by FIG. 2 was used.

As a matter of fact, zirconium tetrachloride sublimes at atmospheric pressure and at 331° C.

Sodium was brought to boiling in the enclosure 14 by means of the furnace 9 before being injected through pipe 15 into the upper portion 2' of the ingot mold 2, while zirconium tetrachloride was sublimed in the enclosure 5 by heating thanks to the furnace 6.

The gaseous flow rate of this halide was imposed by the power dissipated by this furnace 6.

Thus 9 kg of zirconium per hour was prepared by reduction of 23 kg of zirconium tetrachloride with 5 kg of sodium.

The reagent ratio ensured a 25% excess of sodium.

The other conditions were identical to those of the preceding examples, except that the flow rate of reagents was such as to ensure in the reaction zone a higher temperature than the melting temperature of zirconium (1860° C.), i.e. about 1900° C.

EXAMPLE 4

Tantalum was prepared by reduction of tantalum chlorde with hydrogen.

Due to the fact that this is a very refractory metal, the development of this metal in the liquid state requires temperatures higher than 3000° C.

Generally, the metallothermic reduction of the chloride does not furnish calories enough to reach this temperature; moreover, the exothermic reaction has a very low metallurgical yield at very high temperatures.

Thus, in the present case a hydrogen plasma torch appeared as particularly suitable for the make-up of calories.

As a matter of fact, it has been found, on the one hand, that the high temperature necessary for the melting of metal was easily reached and, on the other hand, that the reduction with hydrogen was favored by the high temperature, this reduction being an endothermic reaction.

As tantalum is liquid between 3000° C. and 500° C., the temperature in the reaction zone was maintained near to 4000° C.

Besides, as the tantalum chloride melts at about 220° C., it was in principle possible to impose the flow rate by means of a volumetric pump.

As the temperature range wherein tantalum pentachloride is liquid is limited (about 20° C.), it was however preferred to impose the gaseous flow rate of this chloride by the power dissipated by the furnace 6, according to the embodiment illustrated by FIG. 2 and such as explained in the preceding Example 3.

These reaction conditions thus allowed to prepare 1 kg of tantalum per hour by reducing 2.1 kg of tantalum pentachloride with 1.2 cubic meters of hydrogen, which ensured high excess of reducing agent (molar ratio $H_2/TaCl_5=10$).

Excess of hydrogen was recycled to the reduction.

The metal was solidified in the cooled copper ingot mold, as in the preceding examples.

As it results from the preceding, it is essential that the reagents are charged in the gaseous state directly into the upper portion of the ingot mold, and not for example into a separate reaction chamber.

It has to be understood that the invention is not limited to the embodiments described hereinabove and that many variants can be imagined without departing from the scope of the present patent.

Thus these reactive metals can be prepared in a pure state or as alloys with other reactive or non-reactive elements, such as titanium-aluminum-vanadium alloys.

I claim:

1. A process for preparing alloyed or non-alloyed reactive materials selected from the group consisting of titanium, zirconium, thorium, vanadium, chromium, cobalt, aluminum, silicon, magnesium, and uranium, by reaction of a halide thereof with a reducing agent at a temperature higher than the melting temperature of the metal to be developed, the metal being developed forming into an ingot in an ingot mold, the metal first forming a layer in the liquid state on top of said ingot and then continuously solidifying into the ingot, comprising:

introducing the halide and the reducing agent directly into a reaction zone at the top of the ingot in a swirling motion so as to cause said gaseous reactants to be mixed together in a turbulence in a small area centralized at the top of the ingot and to react according to an exothermic reaction with as little heat loss as possible, while forming a coalescence of liquid droplets of the developed metal which are then collected directly on the liquid metal layer on the top of the ingot;

maintaining in the reaction zone, mainly by means of the calories produced by the exothermic reaction occurring in the small centralized reaction area, a temperature which is higher than the melting point of the metal being developed so as to maintain the top of the ingot in the liquid state, and wherein said temperature is also higher than the boiling or sublimation temperature of the other reaction products developed by said reaction; and substantially continuously discharging said other reaction products in the gaseous state.

2. A process in accordance with claim 1 wherein the ingot of developed metal is substantially continuously discharged as fast as said metal is developed.

3. A process in accordance with claim 1, wherein each said gaseous reactant is introduced at a point within the reaction zone spaced from the point of introduction of the other said reactant to permit mixture of the reactants within the turbulence of the small centralized reaction zone at the top of the ingot.

4. A process in accordance with claim 3, wherein said gaseous reactants are introduced into the reaction zone along a direction which is sloped with respect to the vertical.

5. A process in accordance with claim 1, wherein said gaseous reactants are introduced into the reaction zone as a substantially circular or helical stream.

6. A process in accordance with claim 3, wherein the reaction zone is formed within the upper portion of the ingot mold.

7. A process in accordance with claim 1, further including the step of heating at least one of the reactants during a first step up to its melting, temperature, then heating said reactant in a second step to a temperature at least equal to the boiling temperature thereof, and substantially continuously transferring said reactant from the first to the second heating steps.

8. A process in accordance with claim 1, in which one of said reactants sublime at atmospheric pressure, further including the step of heating said reactant at least to the sublimation temperature thereof, and regulating the flow rate of said reactant to the reactant zone by control of calories furnished during said heating step.

9. A process in accordance with claim 1, wherein said reducing agent is an alkali or alkaline earth metal.

10. A process in accordance with claim 1, wherein said reducing agent comprises a combination of reducing metal and hydrogen.

11. A process in accordance with claim 1, wherein said reducing agent is hydrogen.

12. A unit in accordance with claim 1, further including removal means for removing the ingot in said ingot mold progressively as the metal is developed at the top of said mold.

13. A process in accordance with claim 1, wherein the temperature being maintained in the reaction zone is maintained solely by means of the calories produced by the exothermic reaction.

14. A unit for preparing alloyed or non-alloyed reactive metals by reacting a halide of the reactive metal with a reducing agent at a temperature higher than the melting temperature of the metal to be developed, comprising:

a cooled ingot mold;

charging means for introducing the reactants in the gaseous state in a direction sloped with respect to the vertical into a reaction zone within and at the top of said cooled ingot mold, so as to form at the top of said ingot mold a substantially swirling stream of the gaseous reactants, which swirling stream allows the projection of coalesced droplets of the metal being developed out of the stream due to the centrifugal force created in the stream; and discharge means for substantially continuously discharging gases issuing from the reaction.

15. A unit in accordance with claim 14, further including inert atmosphere means for maintaining a substantially inert atmosphere in the upper portion of said cooled ingot mold.

16. A unit in accordance with claim 14, wherein said discharge means comprises means for drawing out the gases issuing from the reaction from the upper portion of said ingot mold along a different direction from that of the centrifugal force being developed by said swirling stream.

17. A unit in accordance with claim 14, wherein said charge means further includes a preheating enclosure for heating the reactants to a temperature sufficient to achieve the gaseous state thereof prior to the introduction of the reactants into the reaction zone.

18. A unit in accordance with claim 17, wherein said preheating enclosure comprises a first enclosure means for bringing each reactant to the liquid state, a second enclosure means for bringing each liquid reactant transferred thereto from said first enclosure means to the vapor state, and transfer means connecting said first and second enclosure means.

19. A unit in accordance with claim 14, wherein said charging means include an injection pipe for each reactant, each pipe opening into a location situated substantially in the proximity of the side wall of said ingot mold and the opening of each pipe being directed in a direction situated in a different plane each plane being tangent in a cylinder coaxially with said ingot mold, the said pipes having horizontal components oriented in the same circular direction.

20. A unit in accordance with claim 14, further including a cover which substantially sealingly fits on the upper portion of said ingot mold.

21. A unit in accordance with claim 20, wherein said charging means have openings located in or slightly below said cover.

* * * * *